US007704001B2

(12) United States Patent
Igarashi

(10) Patent No.: US 7,704,001 B2
(45) Date of Patent: Apr. 27, 2010

(54) IMAGE FORMING APPARATUS

(75) Inventor: Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 687 days.

(21) Appl. No.: 11/614,612

(22) Filed: Dec. 21, 2006

(65) Prior Publication Data

US 2007/0147882 A1 Jun. 28, 2007

(30) Foreign Application Priority Data

Dec. 27, 2005 (JP) ..... 2005-375588

(51) Int. Cl.
*B41J 3/39* (2006.01)
*B41J 29/02* (2006.01)
*G03G 15/00* (2006.01)

(52) U.S. Cl. ..... 400/691; 400/693; 400/690.4; 347/108; 399/110

(58) Field of Classification Search ..... 400/120.16, 400/690.4; 399/110; 347/108; 292/336.3
See application file for complete search history.

(56) References Cited

U.S. PATENT DOCUMENTS 5,041,872 A * 8/1991 Nukaya et al. ..... 399/107
5,121,521 A 6/1992 Hagiwara et al.
6,443,645 B1 9/2002 Takei et al.
6,782,223 B2 * 8/2004 Yoshida ..... 399/124
6,802,603 B1 10/2004 Montagutelli
7,430,385 B2 * 9/2008 Yamaoka ..... 399/110
2004/0096256 A1 5/2004 Hayashi et al.

FOREIGN PATENT DOCUMENTS

EP 0765761 A2 4/1997
FR 2796001 A 1/2001
JP 3267226 11/1991

OTHER PUBLICATIONS

EP Search Report dtd Mar. 18, 2008, EP Appln. 06026478.5

* cited by examiner

*Primary Examiner*—Daniel J Colilla
*Assistant Examiner*—Marissa L Ferguson-Samreth
(74) *Attorney, Agent, or Firm*—Banner & Witcoff, Ltd.

(57) ABSTRACT

A door main body of a door unit is swingably supported at a casing main body by a hinge mechanism. A conveying guide part is configured to guide conveying of a recording medium. A positioning contact part is configured to be in contact with a main-body-side contact part when the door unit is closed, thereby positioning the conveying guide part with respect to the casing main body. A locking mechanism is provided on a first side with respect to the positioning contact part. The hinge mechanism is provided on a second side that is opposite to the first side. The urging member is configured to apply an urging force to a predetermined part of the door main body. The predetermined part is located on the second side, thereby increasing contact pressure between the positioning contact part and the main-body-side contact part.

10 Claims, 12 Drawing Sheets

IMAGE FORMING APPARATUS

CROSS REFERENCE TO RELATED APPLICATIONS

This application claims priority from Japanese Patent Application No. 2005-375588 filed Dec. 27, 2005. The entire content of the priority application is incorporated herein by reference.

TECHNICAL FIELD

The invention relates to an image forming apparatus.

BACKGROUND

A laser printer accommodates therein image forming devices including an exposure device (scanner), a transfer device (process cartridge), a fixing device, and the like. To remove a recording medium such as recording paper or OHP sheet which gets jammed in the laser printer, a casing main body which accommodates the image forming devices therein is generally formed with an opening for maintenance. An open-close door (open-close cover) for opening/closing the opening is provided at the casing main body.

For example, Japanese Patent Application Publication No. 3-267226 disclose an image forming apparatus that includes a conveying roller mechanism for guiding and conveying a recording medium pinched between a pair of rollers which are disposed in confrontation with each other. By rotatably providing one of the pair of rollers to a casing main body and rotatably providing the other roller to the open-close door, a pinched state of the recording medium can be easily released. Consequently, the jammed recording medium can be easily removed.

However, the open-close door is generally attached to the casing main body through a hinge mechanism and the hinge mechanism typically has a relatively large mechanical play. Thus, when one of the pair of rollers is rotatably provided at the casing main body and the other roller is rotatably provided at the open-close door, accuracy in relative position between the roller provided at the casing main body (hereinafter, referred to as a main-body-side roller) and the roller provided at the open-close door (hereinafter, referred to as a door-side roller) is lowered due to the mechanical play of the open-close door.

Thus, in the image forming apparatus described in the above-mentioned publication, the main-body-side roller is positioned with respect to the door-side roller by bringing a part of the open-close door (hereinafter, referred to as a door-side contact part) into contact with a part of the casing main body (hereinafter, referred to as a main-body-side contact part) and both the contact parts reliably come into contact with each other by pressing the door-side contact part onto the main-body-side contact part with an urging force of a coil spring.

SUMMARY

To position the open-close door (door-side roller) with respect to the casing main body (main-body-side roller) with high accuracy by pressing the door-side contact part onto the main-body-side contact part, it is necessary to apply, to the door-side contact part, a pressing force by which contact pressure of a predetermined amount or larger is generated.

However, in the image forming apparatus described in the above-mentioned publication, since the coil spring applies an urging force to a point near the door-side contact part, the magnitude of the pressing force for pressing the door-side contact part is nearly equal to the magnitude of the urging force generated by the coil spring. Accordingly, in order to obtain a large pressing force, the coil spring needs to be increased in size or compression amount of the coil spring when the door-side contact part contacts the main-body-side contact part needs to be made larger.

Accordingly, in the image forming apparatus described in the above-mentioned publication, in order to position the open-close door with respect to the casing main body with high accuracy, an area which accommodates an urging member such as a coil spring needs to be made larger, resulting in upsizing of the image forming apparatus.

In view of the foregoing, it is an object of the invention to provide an image forming apparatus that accurately positions a conveying guide part for guiding conveying of a recording medium with respect to the casing main body while preventing upsizing of the image forming apparatus.

In order to attain the above and other objects, the invention provides an image forming apparatus. The image forming apparatus includes a casing main body, an image forming unit, a hinge mechanism, a door unit, a locking mechanism, and an urging member. The casing main body is formed with an opening and has a main-body-side contact part. The image forming unit is accommodated in the casing main body and is configured to form an image on a recording medium. The hinge mechanism is provided at one end of the opening. The door unit is configured to be swingable about a swing axis for opening and closing the opening. The door unit includes a door main body, a conveying guide part, and a positioning contact part. The door main body is swingably supported at the casing main body by the hinge mechanism. The conveying guide part is configured to guide conveying of the recording medium. The positioning contact part is configured to be in contact with the main-body-side contact part when the door unit is closed, thereby positioning the conveying guide part with respect to the casing main body. The locking mechanism is configured to maintain a state where the door unit is closed. The locking mechanism is provided on a first side with respect to the positioning contact part. The hinge mechanism is provided on a second side that is opposite to the first side. The urging member is configured to apply an urging force to a predetermined part of the door main body. The predetermined part is located on the second side, thereby increasing contact pressure between the positioning contact part and the main-body-side contact part.

BRIEF DESCRIPTION OF THE DRAWINGS

Embodiments in accordance with the invention will be described in detail with reference to the following figures wherein.

DETAILED DESCRIPTION

Figure 1:
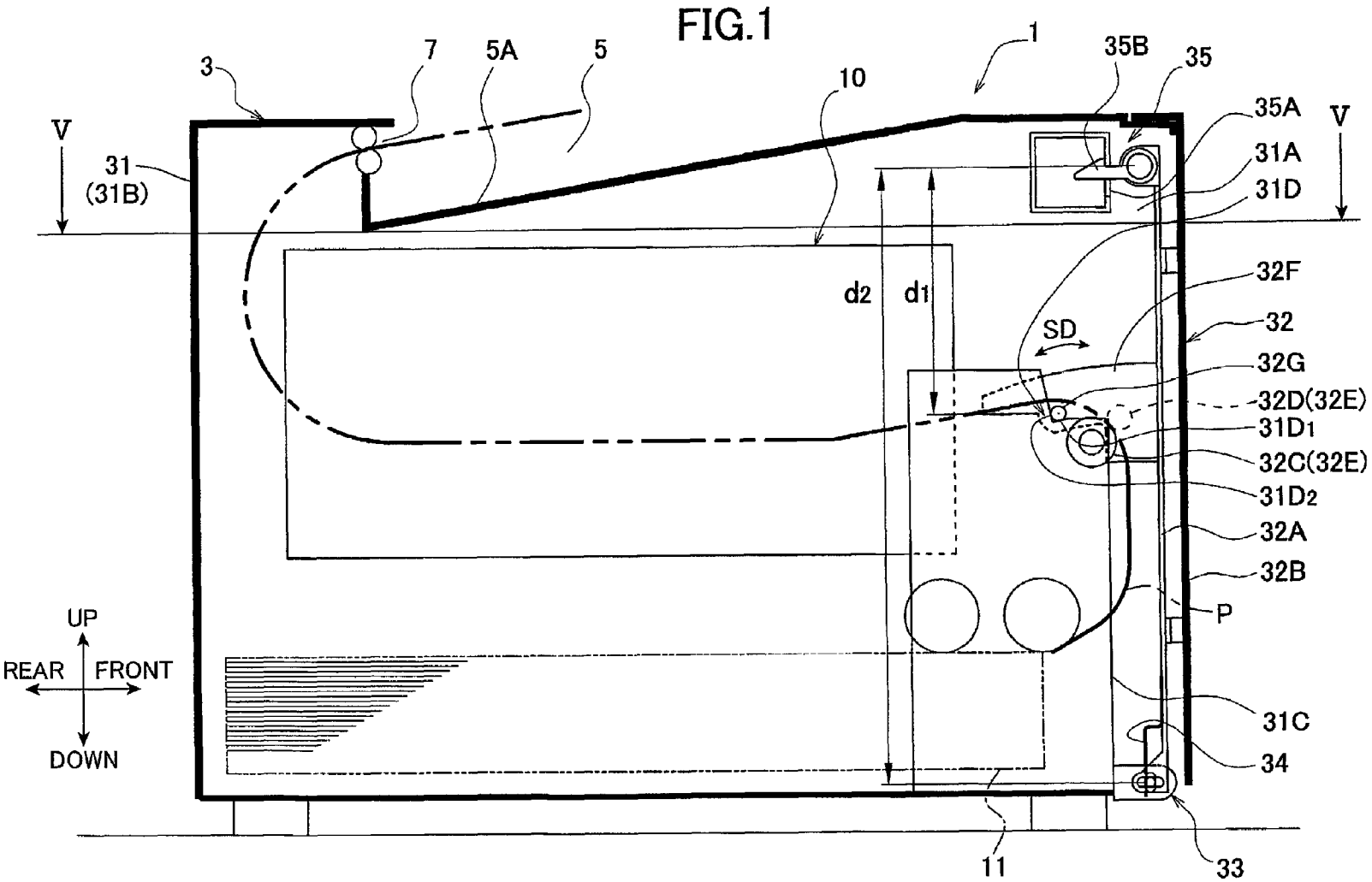
FIG. 1 is a vertical cross-sectional view of an image forming apparatus according to a first embodiment of the invention.

An image forming apparatus according to some embodiments of the invention will be described while referring to the accompanying drawings wherein like parts and components are designated by the same reference numerals to avoid duplicating description.

In the following description, the expressions "front", "rear", "upper", "lower", "right", and "left" are used to define the various parts when the image forming apparatus is disposed in an orientation in which it is intended to be used.

First Embodiment

1. Schematic Configuration of Image Forming Apparatus

As shown in FIG. 1, an image forming apparatus 1 has a substantially cubic or box-like casing 3. The image forming apparatus 1 also includes: an image forming unit 10 using an electrophotographic method; and a sheet feeding tray 11 that accommodates a recording medium such as paper or OHP sheet conveyed to the image forming unit 10. Both the image forming unit 10 and the sheet feeding tray 11 are disposed in the casing 3.

The casing 3 accommodates the image forming unit 10 and the sheet feeding tray 11 therein and includes a casing main body 31 provided with an opening 31A at its horizontal end (front end) and an open-close door 32 (door unit) for opening/closing the opening 31A. The open-close door 32 is swingably provided at the casing main body 31 through a hinge mechanism 33 formed at the lower end of the casing main body 31.

An inclined surface 5A serving as a sheet discharge tray 5 is provided on the upper surface of the casing main body 31 (casing 3). The sheet discharge tray 5 can accommodate the recording medium on which an image is formed by the image forming unit 10. A discharge port 7 for discharging the recording medium is provided at the lower end side of the inclined plane 5A.

1.1. Image Forming Unit

The image forming unit 10 is image forming means using well-known electrophotographic method in which an image is formed by conveying the recording medium accommodated in the sheet feeding tray 11 to a process cartridge including a photoconductive drum and the like which is disposed above the sheet feeding tray 11, transferring an image on the recording medium and heating the recording medium on which the image is transferred at a fixing unit, thereby fixing toner on the recording medium.

The recording medium mounted on the sheet feeding tray 11 is conveyed, along a conveying path P, upward while meandering so that the conveying direction is turned around by approximately 180 degrees at the front end of the image forming apparatus 1 in the front-rear direction and then is discharged onto the sheet discharge tray 5.

1.2. Casing Main Body and Open-Close Door

Figure 2:
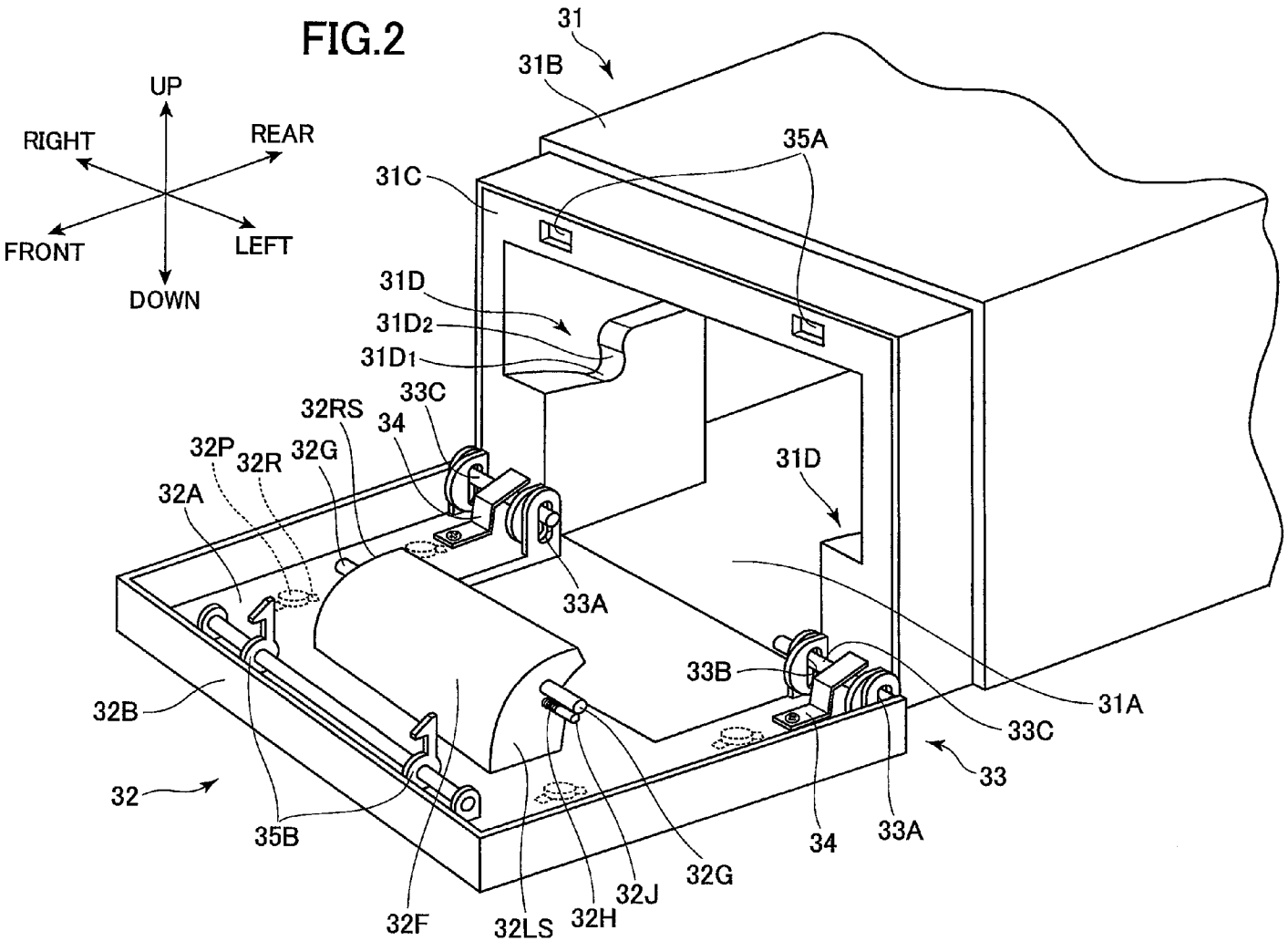
FIG. 2 is a perspective view showing relevant parts of the image forming apparatus according to the first embodiment.

FIG. 2 is a perspective view showing a construction of the casing main body 31 and the open-close door 32 when the open-close door 32 is opened. As shown in FIGS. 1 and 2, the casing main body 31 has a cover unit 31B which has an opening 31A and forms the exterior of the image forming apparatus 1 and a frame unit 31C which is provided in the cover unit 31B and to which the image forming unit 10 and the sheet feeding tray 11 are attached (fixed). In the present embodiment, the cover unit 31B is made of resin and the frame unit 31C is made of resin or metal.

The open-close door 32 has a door main body 32A forming a framework (frame) of the open-close door 32 and a door cover 32B which covers the outside of the door main body 32A and forms a design surface. The hinge mechanism 33 is provided at the casing main body 31 and is coupled to the door main body 32A.

The conveying direction of the recording medium conveyed from the sheet feeding tray 11 to the image forming unit 10 turns around at the opening 31A (open-close door 32) by approximately 180 degrees. Thus, a conveying roller mechanism 32E for applying a conveying force to the recording medium while guiding conveying of the recording medium in contact with the recording medium is provided at the open-close door 32.

Figure 3:
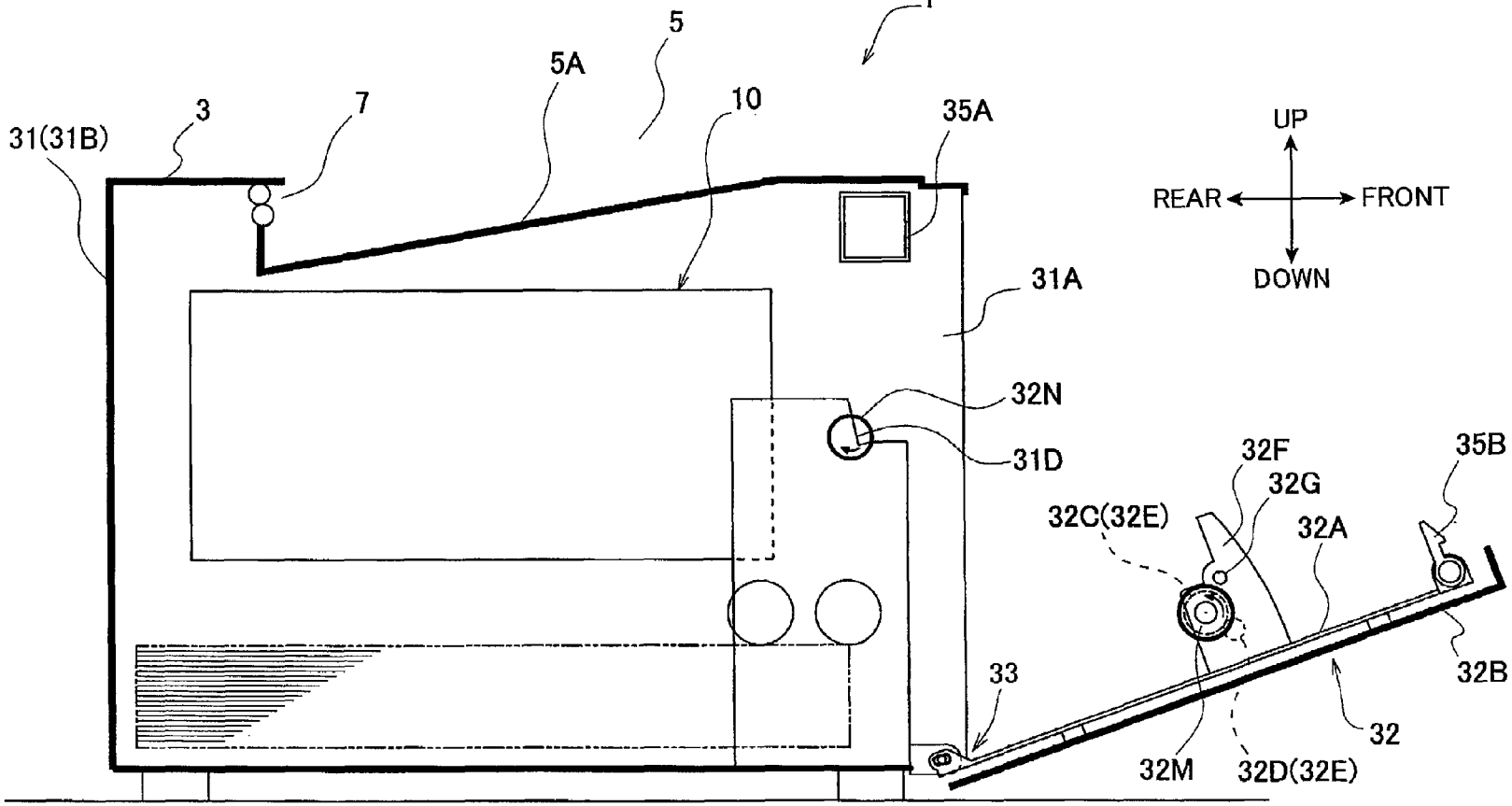
FIG. 3 is a cross-sectional view of the image forming apparatus according to the first embodiment, where an open-close door is opened.

As shown in FIG. 2, an arm part 32F is provided integrally with the door main body 32A. A pair of rollers 32C and 32D constituting the conveying roller mechanism 32E is rotatably provided at the arm part 32F. Thus, as shown in FIG. 3, the rotational centers of the rollers 32C and 32D swingably move about the hinge mechanism 33 together with the open-close door 32 (door main body 32A).

As shown in FIGS. 1 and 2, the arm part 32F is provided with a positioning contact part 32G which is configured to contact a main-body-side contact part 31D provided on the frame unit 31C of the casing main body 31 when the opening 31A is closed, thereby positioning the conveying roller mechanism 32E with respect to the casing main body 31.

Figure 5:
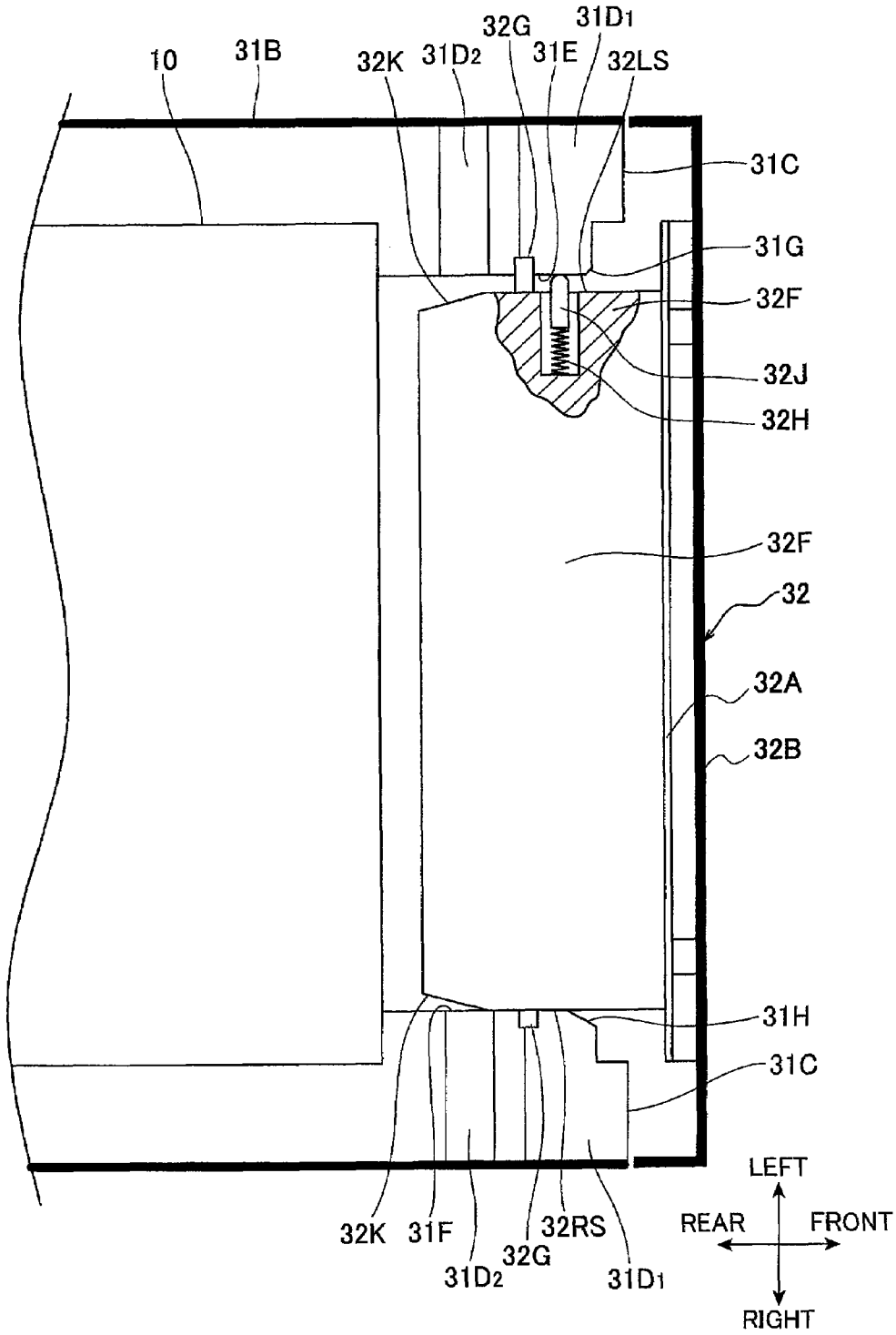
FIG. 5 is a horizontal cross-sectional view of the image forming apparatus according to the first embodiment, taken along a line V-V in FIG. 1.

In the present embodiment, the positioning contact part 32G is, as shown in FIGS. 2 and 5, formed of a circular column-like pin member protruding from the arm part 32F in the horizontal direction (left and right directions) and is provided at both end surfaces 32LS and 32RS of the arm part 32F in the horizontal direction (in the left and right directions of the image forming apparatus 1). Note that FIG. 5 is a horizontal cross-sectional view, taken along a line V-V in FIG. 1.

As shown in FIGS. 1 and 2, the main-body-side contact part 31D includes a substantially L-shaped surface formed of: a contact surface 31D1 that is substantially horizontal and is substantially parallel to a swing direction SD (FIG. 1) of the positioning contact part 32G for contacting the lower end surface of the positioning contact part 32G; and a contact surface 31D2 that is substantially orthogonal to the swing direction SD of the positioning contact part 32G (a radial direction extending from the swing center).

A leaf spring 34 is provided on the side of the hinge mechanism 33 of the open-close door 32 (door main body 32A). The leaf spring 34 is bent like a crank. The leaf spring 34 applies, to the open-close door 32, an urging force (elastic force) for increasing contact pressure between the positioning contact part 32G and the main-body-side contact part 31D (especially, the contact surface 31D2).

A locking mechanism 35 includes a hook-like engaging protrusion 35B for maintaining a closed state of the open-close door 32. The locking mechanism 35 is provided on the opposite side of the open-close door 32 (door main body 32A) to the hinge mechanism 33 across the positioning contact part 32G (in the present embodiment, the upper end side of the door main body 32A).

The locking mechanism 35 includes: an engaging hole 35A formed in the casing main body 31; the hook-like engaging protrusion 35B which is provided at the door main body 32A and is configured to be fitted into and to engage the engaging hole 35A; urging means (not shown) such as a torsion spring that applies an urging force to the engaging protrusion 35B for swinging the engaging protrusion 35B upward, thereby maintaining an engaged state between the engaging protrusion 35B and the engaging hole 35A; a release button (not shown) for swinging the engaging protrusion 35B downward, thereby releasing the engaged state between the engaging protrusion 35B and the engaging hole 35A, and the like.

As shown in FIG. 5, a hole for accommodating a coil spring 32H is formed at the left end of the arm part 32F. The coil spring 32H is fixed to an inner end (right end) of the hole.

A pressing pin 32J is disposed at a free end of the coil spring 32H. The pressing pin 32J is slidable along a guide surface 31E together with swinging of the open-close door 32 in a state where its distal end is in contact with the guide surface 31E of the casing main body 31. The coil spring 32H presses the door main body 32A (open-close door 32) toward the right end in the swing axis direction with a reaction force of pressing the pressing pin 32J onto the guide surface 31E.

Inclined guide surfaces 31G and 31H for guiding the pressing pin 32J and the arm part 32F to the guide surface 31E and the guide surface 31F, respectively, are disposed on the side close to the open-close door 32 of the guide surface 31E and the guide surface 31F. On the other hand, chamfered parts 32K corresponding to the inclined guide surfaces 31G and 31H are provided at the free end (rear end in FIG. 5) of the arm part 32F.

The inclined guide surfaces 31G and 31H are inclined planes which enlarge an opening so as to increase the distance between the guide surface 31E and the guide surface 31F as the inclined guide surfaces 31G and 31H get closer to the open-close door 32. The distal end (left end) of the pressing pin 32J is guided to the guide surface 31E by the inclined guide surface 31G. The side which confronts the guide surface 31F of the arm part 32F is guided to come into contact with the guide surface 31F by the inclined guide surface 31H while being pressed against the guide surface 31F by the coil spring 32H.

1.3. Hinge Mechanism

Figure 4:
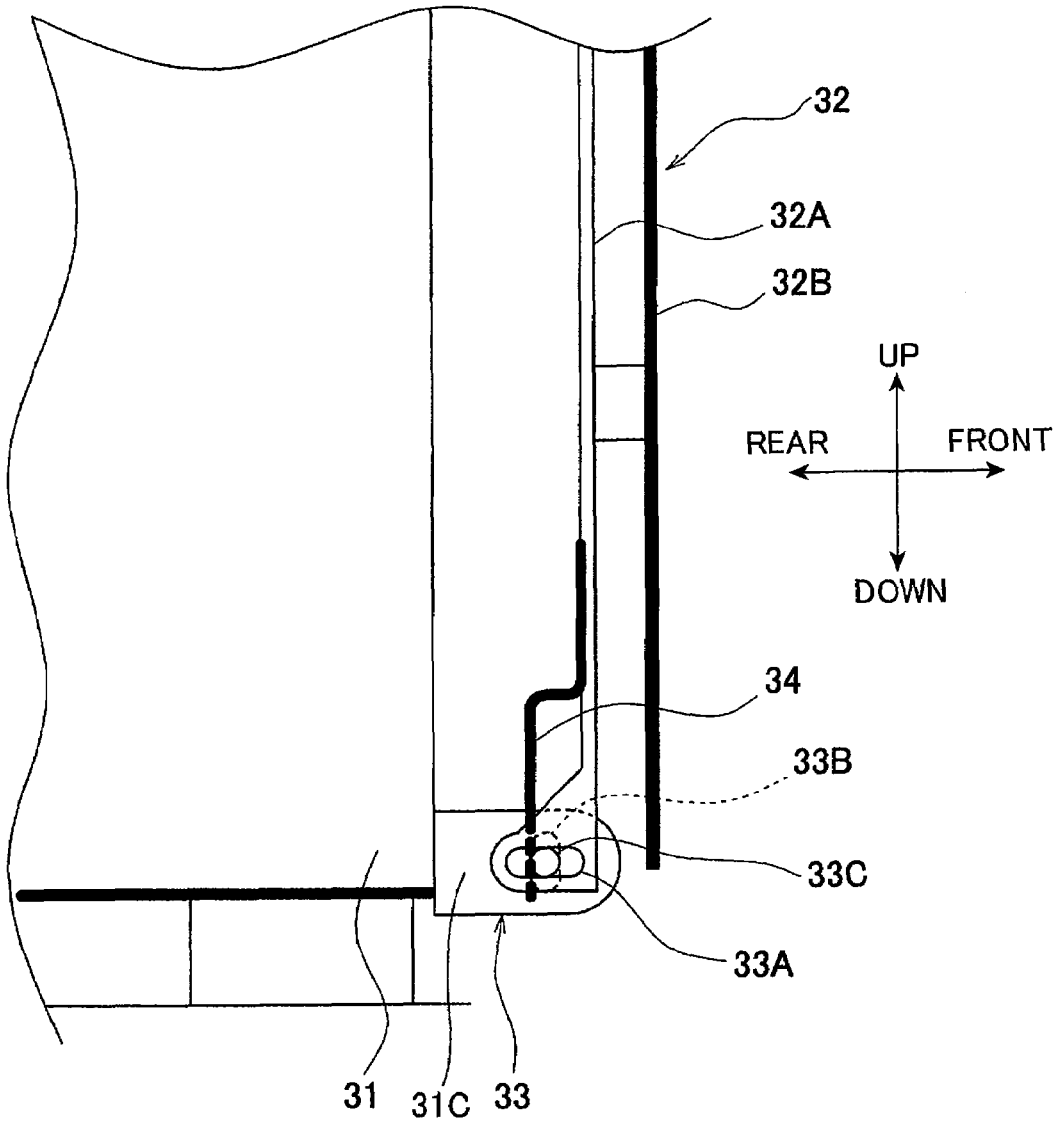
FIG. 4 is an enlarged view of a hinge mechanism in the image forming apparatus according to the first embodiment.

FIG. 4 is an enlarged view of the hinge mechanism 33. As shown in FIG. 4, the hinge mechanism 33 includes: an elongated hole 33A (hereinafter, referred to as a door-side elongated hole 33A) formed in the door main body 32A; an elongated hole 33B (hereinafter, referred to as a main-body-side elongated hole 33B) formed in the casing main body 31; and a shaft 33C which is slidably and rotatably fitted in both the elongated holes 33A and 33B. As shown in FIG. 2, the hinge mechanism 33 is provided on both left and right ends of the casing main body 31.

In the present embodiment, an umbrella-like flange part (not shown) having a larger diameter than the small diameter of both the elongated holes 33A and 33B is provided at one end of the shaft 33C in the longitudinal direction, while a flat washer having a larger diameter than the small diameter of both the elongated holes 33A and 33B is attached to the other end of the shaft 33C. Hence, the shaft 33C is prevented from being dropped from both the elongated holes 33A and 33B.

In the present embodiment, the main-body-side elongated hole 33B is provided so that a large diameter direction of the main-body-side elongated hole 33B corresponds to the vertical direction. Both the elongated holes 33A and 33B are provided so that a large diameter direction of the door-side elongated hole 33A is substantially orthogonal to the large diameter direction of the main-body-side elongated hole 33B when viewed from the axial direction (the direction perpendicular to the sheet of FIG. 4) in a state where the open-close door 32 is closed. That is, the large diameter direction of the door-side elongated hole 33A substantially corresponds to the horizontal direction (front-rear direction).

Thus, in the hinge mechanism 33 in the present embodiment, since the shaft 33C can be slidingly displaced within the main-body-side elongated hole 33B in the large diameter direction, the open-close door 32 can displace by the distance obtained by subtracting the diameter of the shaft 33C from the large diameter of the main-body-side elongated hole 33B in the direction orthogonal to the axial direction (the vertical direction).

The crank-shaped leaf spring 34 applies an urging force for drawing (pulling) the shaft 33C toward the door main body 32A in a state where a fixed side of the leaf spring 34 is fixed at the door main body 32A, thereby applying, to the open-close door 32, an urging force for increasing contact pressure between the main-body-side contact part 31D and the positioning contact part 32G.

In the present embodiment, the large diameter direction of the main-body-side elongated hole 33B corresponds to the vertical direction, and the large diameter direction of the door-side elongated hole 33A substantially corresponds to the horizontal direction when the open-close door 32 is closed. Thus, the large diameter direction of the door-side elongated hole 33A is substantially orthogonal to the large diameter direction of the main-body-side elongated hole 33B when the open-close door 32 is closed.

The leaf spring 34 applies the urging force to the shaft 33C so as to draw the shaft 33C from the casing main body 31 side toward the open-close door 32 side. However, the shaft 33C cannot be displaced with respect to the main-body-side elongated hole 33B in its small diameter direction. Accordingly, the door main body 32A moves in the horizontal direction (toward the casing main body 31 side) which is the large diameter direction of the door-side elongated hole 33A, due to a reaction force of the force by which the leaf spring 34 draws the shaft 33C toward the open-close door 32 side.

At this time, since the shaft 33C is urged to move toward the door main body 32A side (right side in FIG. 4) in the small diameter of the main-body-side elongated hole 33B, the door main body 32A on the side of the hinge mechanism 33 (lower side) is urged to move toward the casing main body 31 side (left side in FIG. 4). As a result, contact pressure between the main-body-side contact part 31D and the positioning contact part 32G increases.

1.4. Conveying Roller Mechanism

Figure 6:
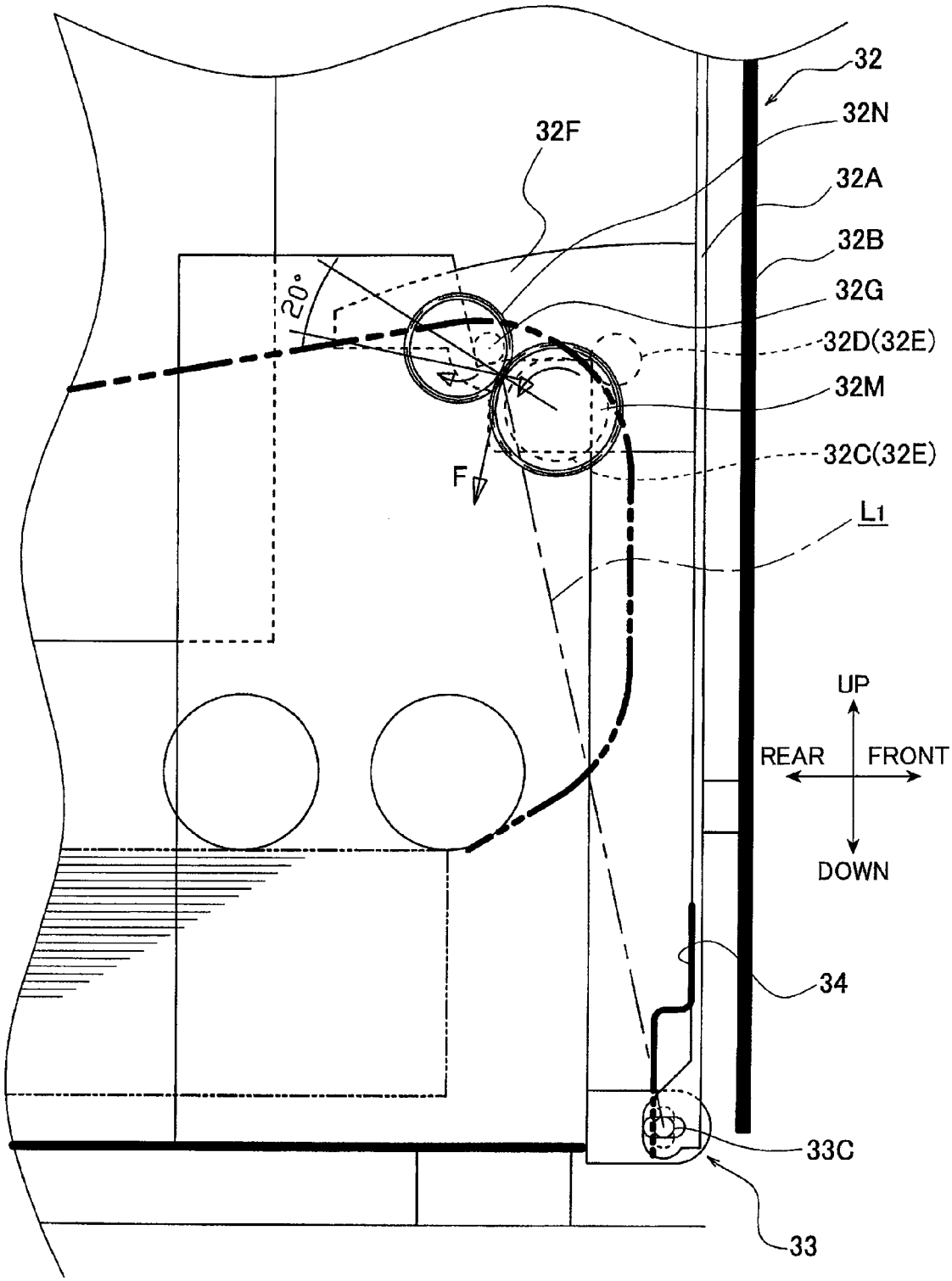
FIG. 6 is an enlarged view of a conveying roller mechanism according to the first embodiment.

As shown in FIG. 6, the conveying roller mechanism 32E is a conveying guide part for guiding and conveying the recording medium nipped between the pair of rollers 32C and 32D. The roller 32C is a driving roller which is rotated by a driving force obtained from the casing main body 31. The roller 32D is a follow roller which presses the recording medium onto the roller 32C and rotates following movement of the recording medium.

A gear 32M rotating integrally with the roller 32C is provided at a rotational shaft (not shown) of the roller 32C. On the other hand, a gear 32N which engages the gear 32M and is rotatably driven by a driving source (not shown) such as an electric motor accommodated in the casing main body 31. Accordingly, when the gear 32N is rotated, a rotational force is transmitted to the gear 32M, thereby rotatably driving the roller 32C and applying a conveying force to the recording medium.

The gear 32M receives a force F from the gear 32N. If the gears 32M and 32N are involute gears, for example, the direction of the force is a direction of a pressure angle at a pitch point (for example, 20 degrees), which is a direction of an angle between a tangent line passing through a pitch point where a pitch circle crosses the involute gear and a normal line extending from the involute gear passing through the pitch point.

Thus, if the force F is directed to the open-close door 32 side with respect to a reference line L1 connecting the pitch point with the center of the shaft 33C, the force F has a component force for opening the open-close door 32. Accordingly, there is possibility that the open-close door 32 is opened due to the force F generated when the roller 32C is driven.

Thus, in the present embodiment, as shown in FIG. 6, the gear 32N is disposed so that the force F is directed toward the image forming unit 10 with respect to the reference line L1. Thus, the force F has a component force for closing the open-close door 32, thereby preventing the open-close door 32 from opening and preventing the positioning contact part 32G and the main-body-side contact part 31D from being separated from each other during conveying of the recording medium.

2. Characteristics of Image Forming Apparatus in the Embodiment

In the present embodiment, the locking mechanism 35 is provided on the opposite side to the hinge mechanism 33 with respect to the positioning contact part 32G. Furthermore, an urging force is applied to the side closer to the hinge mechanism 33 from the positioning contact part 32G of the open-close door 32. Consequently, in the present embodiment, a "lever," mechanism is provided using the position of the locking mechanism 35 as a fulcrum, the position to which the leaf spring 34 of the hinge mechanism 33 applies the urging force as a force input point, and the contact point between the main-body-side contact part 31D and the positioning contact part 32G as a force output point.

As shown in FIG. 1, a pressing force which is applied to the contact point between the main-body-side contact part 31D and the positioning contact part 32G has a magnitude that is obtained by multiplying the urging force applied by the leaf spring 34 by a ratio of a distance d2 between the locking mechanism 35 and the hinge mechanism 33 to a distance d1 between the locking mechanism 35 and the contact point (=d2/d1). Hereinafter, the ratio d2/d1 is referred to as a lever ratio.

Since the locking mechanism 35 is disposed on the opposite side to the hinge mechanism 33 across the positioning contact part 32G, the distance d2 between the locking mechanism 35 and the hinge mechanism 33 is larger than the distance d1 between the locking mechanism 35 and the contact point. Thus, the lever ratio is greater than 1.

Consequently, since the pressing force of pressing the contact point between the main-body-side contact part 31D and the positioning contact part 32G is larger than the urging force generated by the leaf spring 34, the contact pressure between the main-body-side contact part 31D and the positioning contact part 32G can be made larger without increasing the size of a part which accommodates the leaf spring 34. Thus, it is possible to suppress upsizing of the image forming apparatus 1 and to position the conveying roller mechanism 32E with respect to the casing main body 31 with high accuracy.

In the present embodiment, the pressing force generated by the leaf spring 34 presses the positioning contact part 32G mainly onto the contact surface 31D2. When the driving force is not applied to the conveying roller mechanism 32E, position in the front-rear direction is fixed due to the urging force of the leaf spring 34 and position in the vertical direction is fixed by pressing the positioning contact part 32G against the contact surface 31D1 due to self-weight of the open-close door 32 and the conveying roller mechanism 32.

The position in the left-right direction is fixed by pressing the arm part 32F against the guide surface 31F by the coil spring 32H.

When the driving force is applied to the conveying roller mechanism 32E, the downward force for closing the open-close door 32 is applied to the open-close door 32 by the force F applied to the gear 32M. Hence, the positioning contact part 32G is pressed against the contact surface 31D1 and the contact surface 31D2.

Thus, when the driving force is applied to the conveying roller mechanism 32E, the positioning contact part 32G is further pressed against the main-body-side contact part 31D (the contact surface 31D1 and the contact surface 31D2) by the force F applied to the gear 32M in addition to the urging force of the leaf spring 34 and self-weight of the open-close door 32 and conveying roller mechanism 32E, thereby fixing in a position.

Since the conveying roller mechanism 32E is integrally provided with the door main body 32A, when variations in the distance between the hinge mechanism 33 and the conveying roller mechanism 32E are large, there is possibility that the main-body-side contact part 31D cannot contact the positioning contact part 32G.

As a matter of course, when the main-body-side contact part 31D cannot contact the positioning contact part 32G, the conveying roller mechanism 32E cannot be positioned with respect to the frame unit 31C of the casing main body 31 with high accuracy.

In contrast, in the present embodiment, the hinge mechanism 33 is configured so that the open-close door 32 can be displaced by a predetermined distance or greater in the direction orthogonal to the swing axis direction of the door main body 32A by forming the door-side elongated hole 33A as an elongated hole. Thus, even when variations in the distance between the hinge mechanism 33 and the conveying roller mechanism 32E are large, the hinge mechanism 33 can absorb the variations in distance.

Consequently, even when variations in the distance between the hinge mechanism 33 and the conveying roller mechanism 32E are large, since the main-body-side contact part 31D can reliably contact the positioning contact part 32G, the conveying roller mechanism 32E can be positioned with respect to the casing main body 31 with high accuracy.

Since the positioning contact part 32G is provided at the arm part 32F in the open-close door 32 at which the conveying roller mechanism 32E is provided, the conveying roller mechanism 32E requiring the highest positioning accuracy can be reliably positioned.

The image forming unit 10 and many important components are disposed in the vicinity of the conveying roller mechanism 32E. Since the positioning contact part 32G is provided at the arm part 32F at which the conveying roller mechanism 32E is provided and the urging force of the leaf spring 34 is applied to the hinge mechanism 33 away from the conveying roller mechanism 32E, a space for disposing the leaf spring 34 can be ensured and the leaf spring 34 can be reduced in size.

Therefore, it is possible to suppress upsizing of the image forming apparatus 1 more reliably and to position the conveying roller mechanism 32E with respect to the casing main body 31 with high accuracy.

In the present embodiment, since the leaf spring 34 is disposed at the open-close door 32, in comparison with a configuration where the leaf spring 34 is provided at the casing main body 31 which accommodates the image forming unit 10 and other components and thus has a limited space, a space for disposing the leaf spring 34 can be easily ensured.

Second Embodiment

Figure 7:
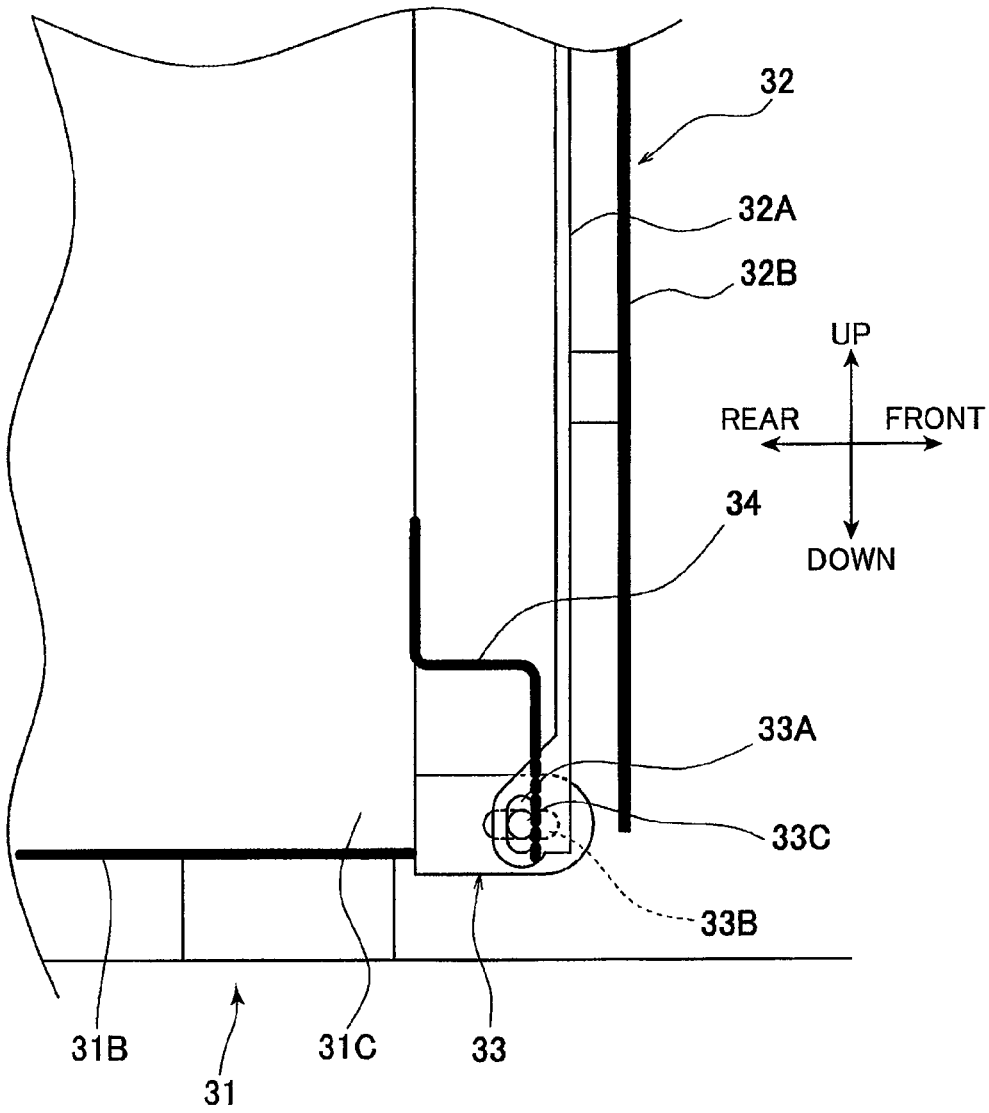
FIG. 7 is a cross-sectional view showing relevant parts (particularly, a hinge mechanism) of an image forming apparatus according to a second embodiment of the invention.

In the present embodiment, as shown in FIG. 7, in contrast to the first embodiment, the crank-shaped leaf spring 34 applies an urging force for drawing (pulling) the shaft 33C toward the casing main body 31 in a state where a fixed side of the leaf spring 34 is fixed at the casing main body 31, thereby applying, to the open-close door 32, an urging force for increasing contact pressure between the main-body-side contact part 31D and the positioning contact part 32G.

In the present embodiment, the large diameter direction of the main-body-side elongated hole 33B corresponds to the horizontal direction (front-rear direction), and the large diameter direction of the door-side elongated hole 33A substantially corresponds to the vertical direction when the open-close door 32 is closed. Thus, the large diameter direction of the door-side elongated hole 33A is substantially orthogonal to the large diameter direction of the main-body-side elongated hole 33B when the open-close door 32 is closed.

The leaf spring 34 applies the urging force to the shaft 33C so as to draw the shaft 33C toward the casing main body 31 side. However, the shaft 33C cannot be displaced with respect to the door-side elongated hole 33A in its small diameter direction. Accordingly, the shaft 33C and the door main body 32A move together (integrally) in the horizontal direction (toward the casing main body 31 side) which is the large diameter direction of the main-body-side elongated hole 33B.

At this time, the door main body 32A on the side of the hinge mechanism 33 (lower side) is urged to move toward the casing main body 31 side (left side in FIG. 7). As a result, contact pressure between the main-body-side contact part 31D and the positioning contact part 32G increases.

The elongated hole in which the shaft 33C is inserted may be formed as a circular hole having the substantially same diameter as the large diameter of the elongated hole. In this configuration, too, the open-close door 32 can be displaced by a predetermined distance or greater in the direction orthogonal to the swing axis direction of the door main body 32A. However, with such configuration, since the position of the shaft 33C becomes unstable when the open-close door 32 is opened or closed, there is high possibility that operational feeling in opening or closing the open-close door 32 deteriorates.

Figure 8A:
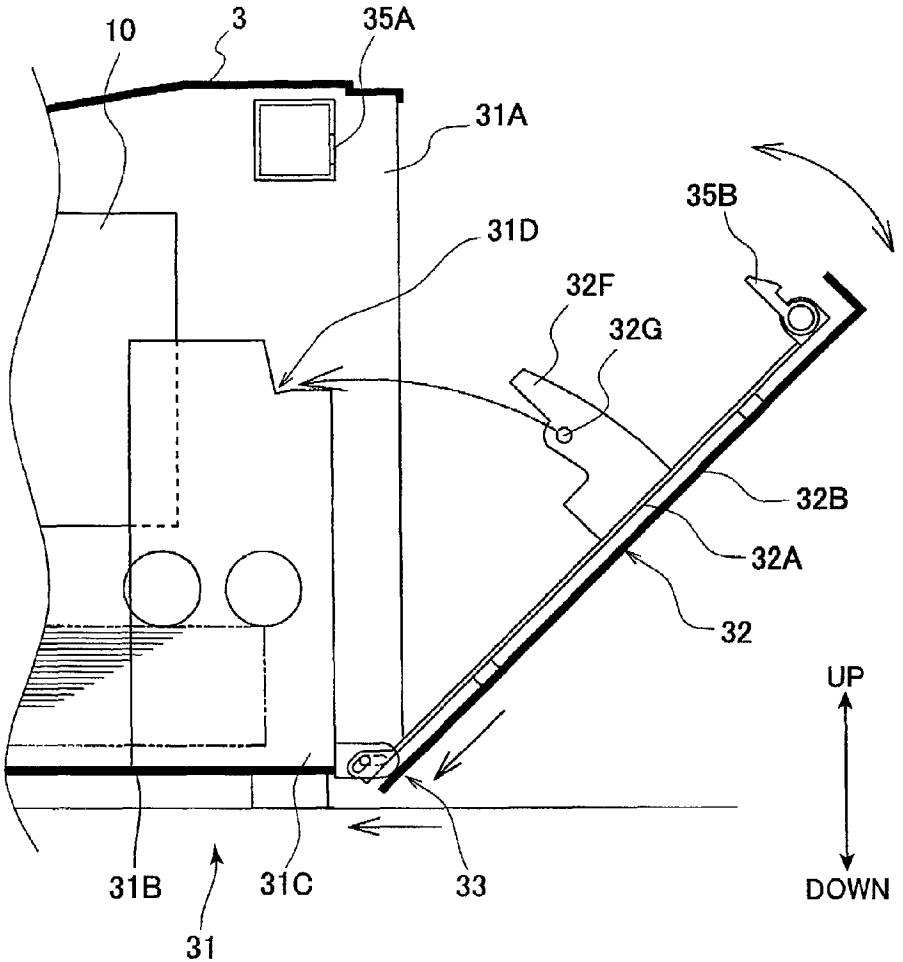
FIG. 8A is an explanatory diagram showing operations of the hinge mechanism according to the second embodiment.
Figure 8B:
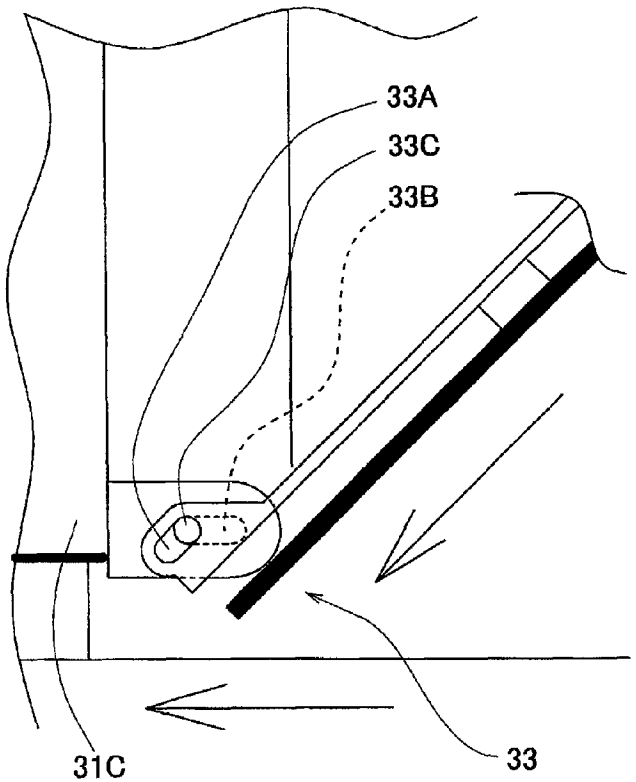
FIG. 8B is a partial enlarged view of FIG. 8A.

In contrast, in the present embodiment, when the open-close door 32 is closed, the large diameter direction of the door-side elongated hole 33A intersects the large diameter direction of the main-body-side elongated hole 33B. Thus, as shown in FIGS. 8A and 8B, when the open-close door 32 is opened or closed due to the self-weight of the open-close door 32, as to the horizontal direction, the shaft 33C is guided in the large diameter direction of the main-body-side elongated hole 33B and moves to the casing main body 31 side, and as to the vertical direction, the shaft 33C is guided in the large diameter direction of the door-side elongated hole 33A and moves to the upper end.

Consequently, since the shaft 33C is located at the ends of both the elongated holes 33A and 33B in the large diameter directions in a stable state when the open-close door 32 is opened or closed, it is possible to prevent that operational feeling in opening or closing the open-close door 32 deteriorates.

Third Embodiment

In the above-described embodiments, the door cover 32B is fixed to the door main body 32A in a state where the door cover 32B cannot be displaced with respect to the door main body 32A. However, in the present embodiment, the door cover 32B is provided at the door main body 32A so as to be displaceable with respect to the door main body 32A.

Figure 9:
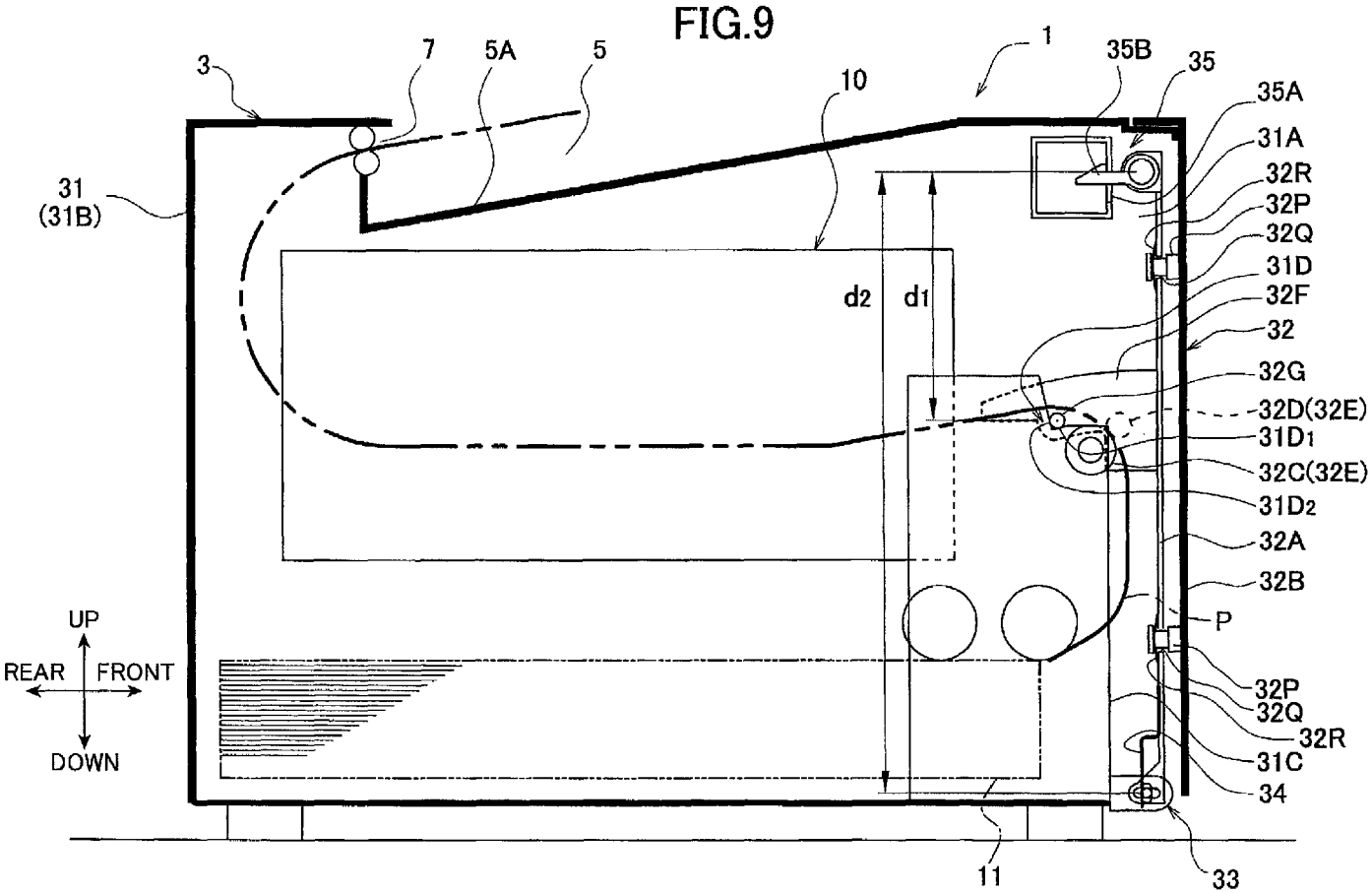
FIG. 9 is a vertical cross-sectional view showing relevant parts of an image forming apparatus according to a third embodiment of the invention, wherein a hinge mechanism has a same configuration as the first embodiment.
Figure 10:
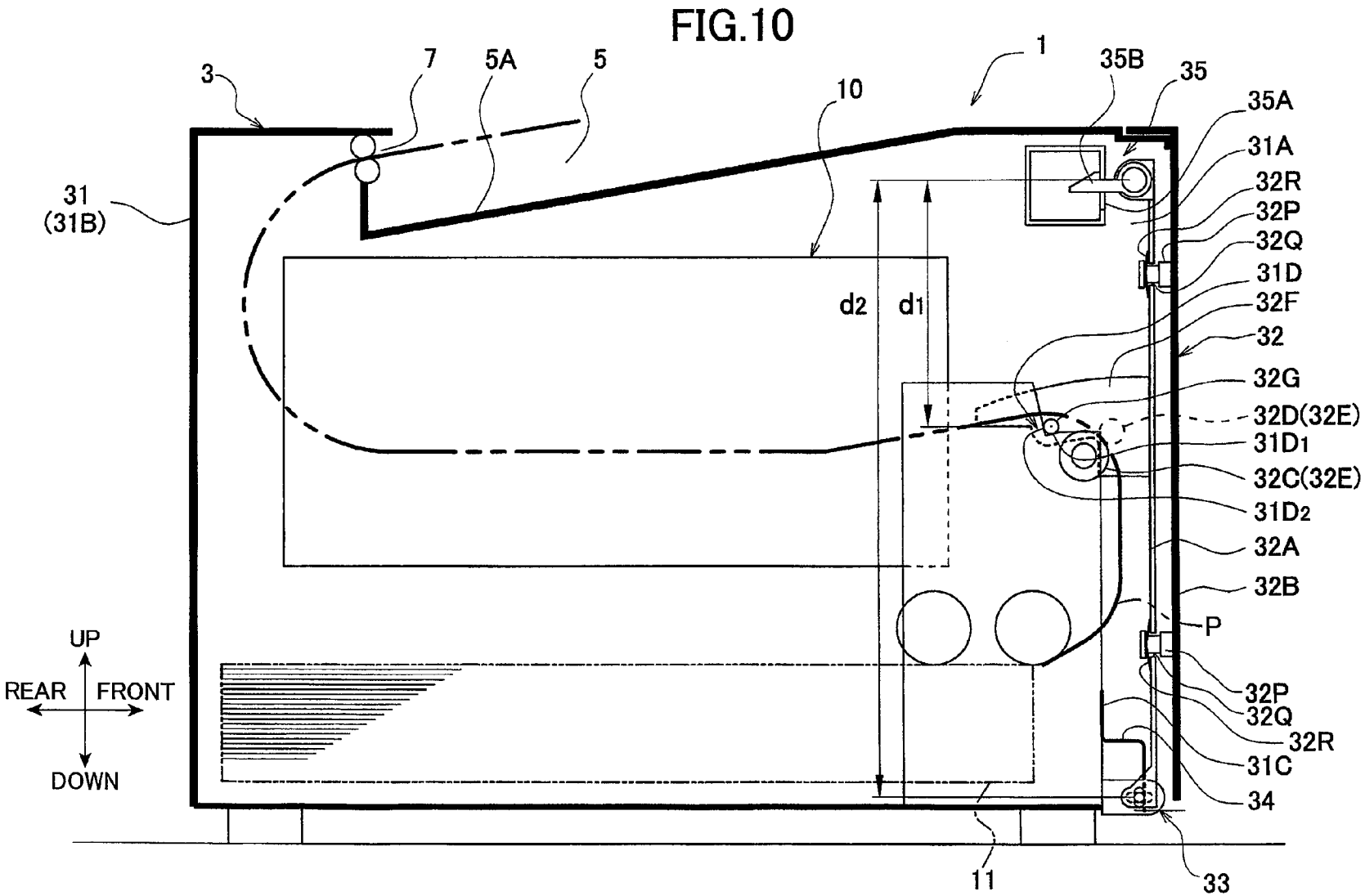
FIG. 10 is a vertical cross-sectional view showing relevant parts of an image forming apparatus according to the third embodiment, wherein a hinge mechanism has a same configuration as the second embodiment.

As shown in FIGS. 9 and 10, a supporting arm 32P protruding by a predetermined distance from the door cover 32B toward the door main body 32A is provided. A through-hole 32Q for allowing the supporting arm 32P to penetrate through the door main body 32A is formed. A distal end of the supporting arm 32P is fixed to a leaf spring 32R, which is fixed to the door main body 32A on the side of the casing main body 31. More specifically, both longitudinal ends of the leaf spring 32R are fixed to the door main body 32A, while a middle part of the leaf spring 32R is fixed to the distal end of the supporting arm 32P. The leaf spring 32R allows the supporting arm 32P to move in the front-rear direction with respect to the door main body 32A by a certain amount. Note that the supporting arm 32P and the leaf spring 32R are shown in dotted lines in FIG. 2 for explanation purposes, although FIG. 2 shows the image forming apparatus in the first embodiment.

Figure 11A:
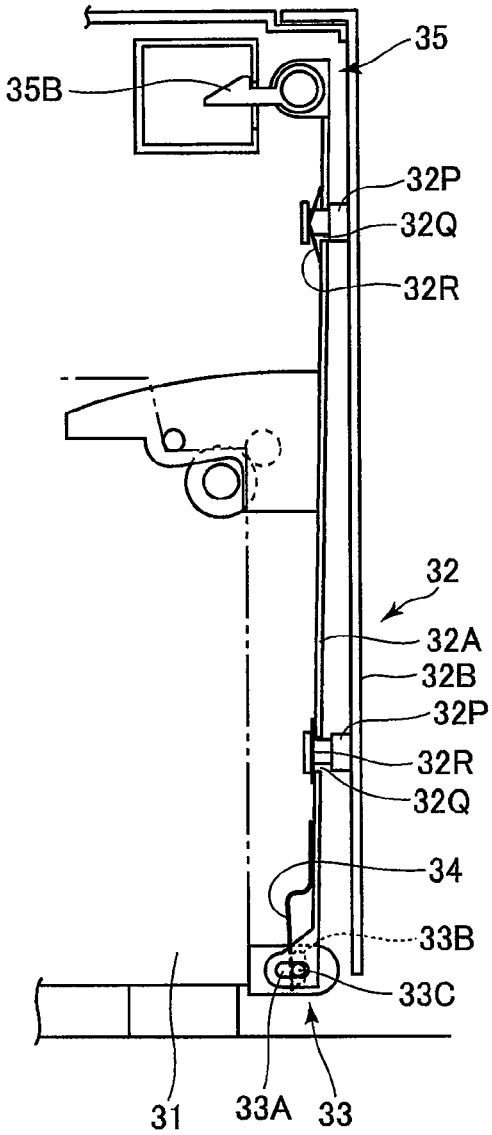
FIG. 11A is a partial cross-sectional view of the image forming apparatus of FIG. 9, for showing a state where a door cover is displaced with respect to a door main body so that the door main body and the door cover is opened on the side of a hinge mechanism.
Figure 11B:
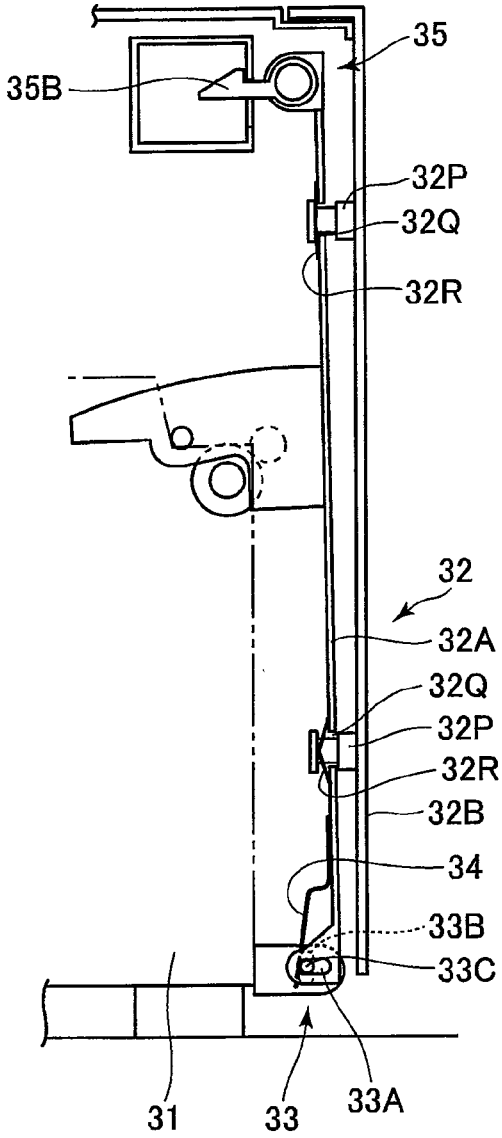
FIG. 11B is a partial cross-sectional view of the image forming apparatus of FIG. 9, for showing a state where the door cover is displaced with respect to the door main body so that the door main body and the door cover is opened on the side of a locking mechanism.

Thus, as shown in FIGS. 11A and 11B, when an external force is applied to the door cover 32B, the leaf spring 32R is bent and deformed and the door cover 32B can be easily displaced with respect to the door main body 32A.

Accordingly, in the present embodiment, since the door main body 32A and the door cover 32B can be independently positioned, the conveying roller mechanism 32E can be positioned with respect to the frame unit 31C of the casing main body 31 without affecting a design surface formed by the door cover 32B.

FIG. 11A is a partial cross-sectional view of the image forming apparatus of FIG. 9, for showing a state where the door cover 32B is displaced with respect to the door main body 32A so that the door main body 32A and the door cover 32B is opened on the side of the hinge mechanism 33. FIG. 11B is a partial cross-sectional view of the image forming apparatus of FIG. 9, for showing a state where the door cover 32B is displaced with respect to the door main body 32A so that the door main body 32A and the door cover 32B is opened on the side of the locking mechanism 35.

Figure 12A:
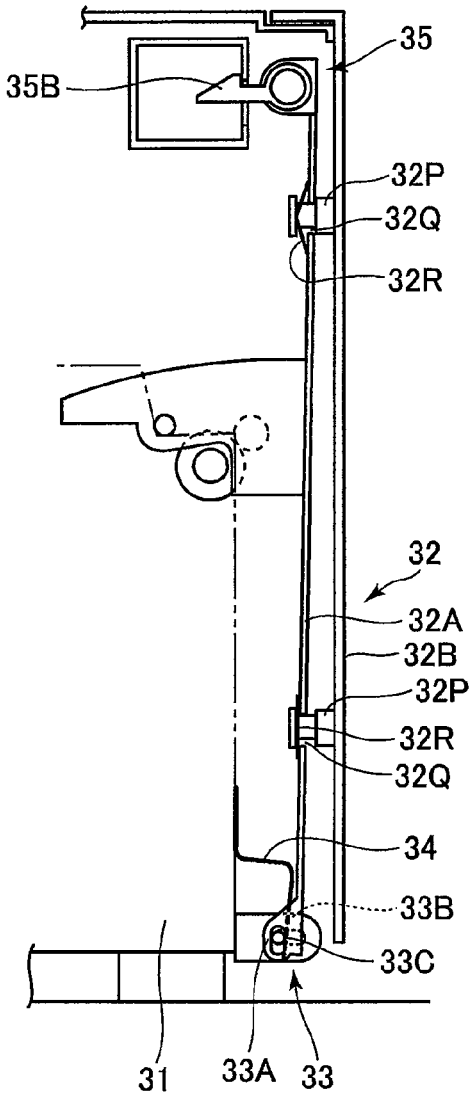
FIG. 12A is a partial cross-sectional view of the image forming apparatus of FIG. 10, for showing a state where a door cover is displaced with respect to a door main body so that the door main body and the door cover is opened on the side of a hinge mechanism.
Figure 12B:
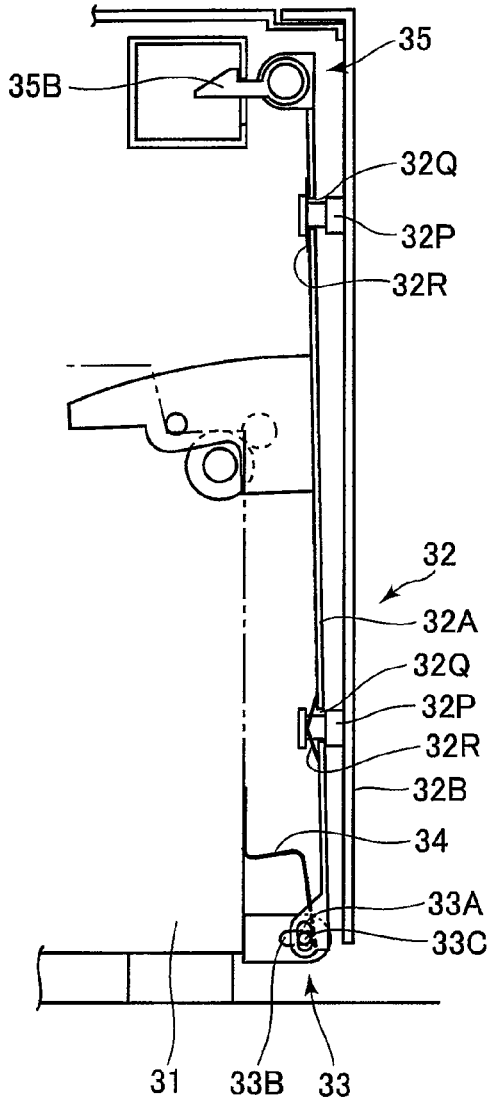
FIG. 12B is a partial cross-sectional view of the image forming apparatus of FIG. 10, for showing a state where the door cover is displaced with respect to the door main body so that the door main body and the door cover is opened on the side of a locking mechanism.

FIG. 12A is a partial cross-sectional view of the image forming apparatus of FIG. 10, for showing a state where the door cover 32B is displaced with respect to the door main body 32A so that the door main body 32A and the door cover 32B is opened on the side of the hinge mechanism 33. FIG. 12B is a partial cross-sectional view of the image forming apparatus of FIG. 10, for showing a state where the door cover 32B is displaced with respect to the door main body 32A so that the door main body 32A and the door cover 32B is opened on the side of the locking mechanism 35.

In the present embodiment, by fixedly supporting the distal end of the supporting arm 32P by the leaf spring 32R fixed to the door main body 32A on the side of the casing main body 31, the door cover 32B can be displaced with respect to the door main body 32A. However, the invention is not limited to this configuration. For example, the door main body 32A is directly coupled to the door cover 32B with elastic means such as a coil spring.

<Modifications>

While the invention has been described in detail with reference to the above embodiments thereof, it would be apparent to those skilled in the art that various changes and modifications may be made therein without departing from the spirit of the invention.

In the above-described embodiments, the engaging hole 35A is formed on the casing main body 31 and the engaging protrusion 35B is provided at the door main body 32A to provide the locking mechanism. However, the invention is not limited to this configuration. For example, the locking mechanism may be constituted by providing the engaging protrusion 35B at the casing main body 31 and forming the engaging hole 35A on the door main body 32A.

In the above-described embodiments, the shaft hole into which the shaft 33C of the hinge mechanism 33 is inserted is formed as an elongated hole. However, the invention is not limited to this configuration. For example, the shaft hole may be formed as a circular hole having a larger diameter than the diameter of the shaft 33C.

In the above-described embodiments, since the shaft 33C of the hinge mechanism 33 can be displaced with respect to both the door main body 32A and the casing main body 31, the hinge mechanism 33 can absorb dimensional variations, thereby reliably bringing the main-body-side contact part 31D into contact with the positioning contact part 32G. However, the invention is not limited to this configuration. For example, the shaft 33C may be fixed to either the door main body 32A or the casing main body 31, and the other shaft hole may be formed as a circular hole having a larger diameter than the diameter of the shaft 33C.

In the above-described embodiments, by providing the umbrella-like flange part having a diameter larger than the small diameter of both the elongated holes 33A and 33B at one end of the shaft 33C in the longitudinal direction and attaching the flat washer having a diameter larger than the small diameter of both the elongated holes 33A and 33B to the other end of the shaft 33C, the shaft 33C is prevented from dropping from both the elongated holes 33A and 33B. However, the invention is not limited to this configuration, and other means for preventing dropping of the shaft 33C may be provided.

In the above-described embodiments, both the rollers 32C and 32D constituting the conveying roller mechanism 32E are provided at the open-close door 32. However, the invention is not limited to this configuration. For example, the driving roller 32C may be provided at the casing main body 31.

In the above-described embodiments, the conveying roller mechanism 32E serves as the conveying guide part. However, the invention is not limited to this configuration. For example, a guide surface which slidingly contacts a conveyed recording medium may constitute the conveying guide part.

In the above-described embodiments, the positioning contact part 32G is disposed at the arm part 32F. However, the positioning contact part 32G only needs to be disposed between the hinge mechanism 33 and the locking mechanism 35 in the door main body 32A.

What is claimed is:

1. An image forming apparatus comprising:

a casing main body that is formed with an opening and that has a main-body-side contact part;

an image forming unit that is accommodated in the casing main body and that is configured to form an image on a recording medium;

a hinge mechanism provided at one end of the opening;

a door unit that is configured to be swingable about a swing axis for opening and closing the opening, the door unit including:

a door main body that is swingably supported at the casing main body by the hinge mechanism;

a conveying guide part that is configured to guide conveying of the recording medium; and a positioning contact part that is configured to be in contact with the main-body-side contact part when the door unit is closed, thereby positioning the conveying guide part with respect to the casing main body;

a locking mechanism that is configured to maintain a state where the door unit is closed, the locking mechanism being provided on a first side with respect to the positioning contact part, the hinge mechanism being provided on a second side that is opposite to the first side; and an urging member that is configured to apply an urging force to a predetermined part of the door main body, the predetermined part being located on the second side, thereby increasing contact pressure between the positioning contact part and the main-body-side contact part, wherein the hinge mechanism includes:

a door-side elongated hole that is formed in the door main body, a main-body-side elongated hole that is formed in the casing main body, and a shaft that is slidably and rotatably fitted in both the door-side elongated hole and the main-body-side elongated hole, and wherein a large diameter direction of the door-side elongated hole and a large diameter direction of the main-body-side elongated hole are substantially orthogonal to each other when the door unit is closed.

2. The image forming apparatus according to claim 1, wherein the hinge mechanism is configured in such a manner that the door main body can be displaced by a predetermined distance in a direction orthogonal to the swing axis.

3. The image forming apparatus according to claim 1, wherein the positioning contact part is provided at the conveying guide part in the door unit.

4. The image forming apparatus according to claim 1, wherein the urging member has:

a fixed side that is fixed to the door main body; and a free side that is opposite to the fixed side and that applies the urging force to the shaft in an urging direction; and wherein, when the door unit is closed, the large diameter direction of the main-body-side elongated hole intersects the urging direction.

5. The image forming apparatus according to claim 1, wherein the urging member has:

a fixed side that is fixed to the casing main body; and a free side that is opposite to the fixed side and that applies the urging force to the shaft in an urging direction; and wherein, when the door unit is closed, the large diameter direction of the door-side elongated hole intersects the urging direction.

6. The image forming apparatus according to claim 1, wherein the conveying guide part includes a conveying roller and a first gear that rotates integrally with the conveying roller;

further comprising a second gear that engages the first gear and that is rotatably driven by a driving source accommodated in the casing main body, the first gear receiving a force from the second gear;

wherein a reference line is defined in such a manner that the reference line connects a center of the shaft with a pitch point of the first and second gears; and wherein the second gear is disposed so that the force is directed toward the image forming unit with respect to the reference line.

7. The image forming apparatus according to claim 1, wherein the door unit further includes a door cover that covers an outside of the door main body, thereby forming a design surface; and wherein the door cover is attached to the door main body so as to be displaceable with respect to the door main body.

8. The image forming apparatus according to claim 1, wherein the door unit further includes an arm part that is provided at the door main body;

wherein the conveying guide part includes a conveying roller that is rotatably provided at the arm part; and wherein the positioning contact part is formed of a circular column-like member protruding from the arm part in an axial direction parallel to the swing axis, the positioning contact part being provided at both ends of the arm part in the axial direction.

9. The image forming apparatus according to claim 8, wherein the main-body-side contact part includes a substantially L-shaped surface having:

a first contact surface that is substantially horizontal and is substantially parallel to a swing direction of the positioning contact part for contacting a lower end surface of the positioning contact part; and a second contact surface that is substantially orthogonal to the swing direction of the positioning contact part.

10. The image forming apparatus according to claim 8, wherein the arm part has both end surfaces in the axial direction;

wherein the casing main body has guide surfaces that are configured to confront respective ones of the both end surfaces of the arm part when the door unit is closed; and wherein a spring is provided at one of the both end surfaces of the arm part, the spring being configured to press the arm part against one of the guide surfaces at a side opposite to the spring, thereby fixing a position of the positioning contact part in the axial direction.

* * * * *